US010450772B2

(12) United States Patent
LaHood

(10) Patent No.: US 10,450,772 B2
(45) Date of Patent: Oct. 22, 2019

(54) REMOVABLE FLOOR FOR A PORTABLE SHELTER

(71) Applicant: CLAM CORPORATION, Rogers, MN (US)

(72) Inventor: John Matthew LaHood, Waconia, MN (US)

(73) Assignee: Clam Corporation, Rogers, MN (US)

( * ) Notice: Subject to any disclaimer, the term of this patent is extended or adjusted under 35 U.S.C. 154(b) by 0 days.

(21) Appl. No.: 15/861,411

(22) Filed: Jan. 3, 2018

(65) Prior Publication Data

US 2019/0203501 A1 Jul. 4, 2019

(51) Int. Cl.
*E04H 15/56* (2006.01)

(52) U.S. Cl.
CPC ..... *E04H 15/56* (2013.01)

(58) Field of Classification Search
CPC ..... E04H 15/48; E04H 15/56; E04H 15/44; E04H 15/36; E04H 15/32; E04H 15/64; B32B 37/12; B32B 37/14
USPC ..... 135/135, 137, 147–148, 151, 152, 116, 135/115, 119, 905
See application file for complete search history.

(56) References Cited

U.S. PATENT DOCUMENTS 1,728,356 A * 9/1929 Morgan ..... E04H 15/50 135/154
4,239,247 A 12/1980 Hinz
4,305,414 A * 12/1981 Bareis ..... E04H 15/56 135/116
5,622,198 A 4/1997 Elsinger
5,749,387 A 5/1998 Thompson
6,167,898 B1 * 1/2001 Larga ..... E04H 15/20 135/124
6,948,280 B2 9/2005 Marcinkowski et al.
7,665,478 B2 * 2/2010 Wehner ..... A01G 9/16 135/126
8,161,992 B2 * 4/2012 Cantwell ..... E04H 15/54 135/116
9,416,527 B2 8/2016 McInerney
9,512,632 B2 12/2016 Cook
9,771,729 B2 * 9/2017 Workman ..... E04H 15/44
9,777,507 B2 10/2017 Walter
9,777,508 B2 * 10/2017 Kalvani ..... E04H 15/56
2003/0106578 A1 * 6/2003 Cornist ..... E04H 15/324 135/137

(Continued)

OTHER PUBLICATIONS

Web page from Dick's Sporting Goods showing a Clam Jason Mitchell 5000 Thermal 6-Person Ice Fishing Shelter (date unknown but prior to U.S. Appl. No. 15/681,402).

(Continued)

*Primary Examiner* — Winnie Yip
(74) *Attorney, Agent, or Firm* — Cook Alex Ltd.

(57) ABSTRACT

A removable floor for use with a portable shelter, the floor including a central section defining a ground engaging area and having at least one layer constructed of a non-permeable material, at least one side wall extending upward from and being connected to the central section at an edge of the ground engaging area and having an outward facing side wall fastener, and at least one initial locating fastener extending outward relative to the at least one side wall of the floor. The floor is usable in combination with a portable shelter having complementary fasteners for releasable connection of the floor to the shelter.

16 Claims, 4 Drawing Sheets

(56) References Cited

U.S. PATENT DOCUMENTS

| | | | | |
|---|---|---|---|---|
| 2006/0021643 | A1 | 2/2006 | Brensinger | |
| 2006/0048459 | A1 | 3/2006 | Moore | |
| 2006/0169729 | A1 | 8/2006 | Reis | |
| 2006/0243312 | A1* | 11/2006 | Williamson | E04H 15/44 135/121 |
| 2010/0307550 | A1 | 12/2010 | Silverberg et al. | |
| 2012/0211042 | A1 | 8/2012 | Richter | |
| 2017/0167158 | A1* | 6/2017 | Lynch | E04H 15/40 |

OTHER PUBLICATIONS

Web page from Dick's Sporting Goods showing a Clam Outdoors Quick-Set Pavilion Screen House (date unknown but prior to U.S. Appl. No. 15/681,402).

Web page from polarbird.com showing a 4T Insulated Floor for an Ice Shelter, and related photographs (date unknown but prior to U.S. Appl. No. 15/681,402).

* cited by examiner

REMOVABLE FLOOR FOR A PORTABLE SHELTER

BACKGROUND OF THE INVENTION

Field of the Invention

The present invention generally relates to portable shelters, and more particularly to a removable floor for a portable shelter.

Discussion of the Prior Art

Portable shelters, which may be configured as a screen tent, gazebo canopy, pop up shelter or the like, may be used for numerous outdoor activities, such as camping, picnics or gatherings. Such shelters are known and typically include a lightweight flexible enclosure supported by a collapsible frame. While many shelter constructions exist, the flexible enclosure often has multiple side walls, with each side wall connected to adjacent side walls and to a top wall. The side walls may feature continuous fabric panels or may contain sections of screen to permit air flow, while keeping insects out of the sheltered area. When the collapsible frame is erected, the enclosure is free standing. Such portable shelters generally are sized to accommodate multiple individuals and fixtures such as a table and chairs or other gear, but they certainly may provide configurations of various sizes.

The side walls and top wall may be constructed using various sheet materials when forming broad panels, including fabrics, such as canvas, polyester or nylon, and may include screen or mesh portions. The panels also may have an additional rainfly, rain flap or other additional covering that may be deployed over fabric or screen areas. While screen portions on the side walls are advantageous for limiting insect intrusion, a shelter that provides side walls but is open to the ground tends to lessen the protection, and contact with the ground can soil gear or result in less comfortable use of the shelter.

Shelter floors are known but can be problematic. They may be difficult to install and/or may not retain their position relative to the shelter, which can increase the likelihood of becoming a tripping hazard. It would be desirable to have a floor that is easy to install, secure once installed and that keeps out dirt, water and insects.

SUMMARY OF THE INVENTION

The purpose and advantages of the invention will be set forth in and apparent from the description and drawings that follow, as well as will be learned by practice of the claimed subject matter.

This disclosure generally provides removable floors for portable shelters, which provide a unique structure resulting in desirable advantages. The floor of the present disclosure is easily installed and maintains its position relative to the side walls of the shelter. The floor may be constructed of one or more layers of non-permeable sheet material, and preferably is constructed of a single-ply flame retardant polyvinyl chloride (FR PVC) sheet material, although it will be appreciated that other materials may be used whether in a single layer or multiple layers. Such materials suitably retain the qualities of being compact, light-weight and easy to set-up, yet can be configured to have unique, desirable advantages. They may provide flame retardant properties, while avoiding openings, such as stitching lines, which may otherwise permit dirt, water or insect intrusion. This may advantageously provide users a cleaner, dryer and more comfortable interior environment.

In a first aspect, this disclosure provides a removable floor for use with a portable shelter, with the floor including a central section defining a ground engaging area and having at least one layer constructed of a non-permeable material. The floor also includes at least one side wall extending upward from and being connected to the central section at an edge of the ground engaging area and further includes at least one layer constructed of a non-permeable material, wherein the at least one side wall has an inward facing surface and an outward facing surface. The floor further includes an outward facing side wall fastener located on the outward facing surface of the at least one side wall, and at least one initial locating fastener extending outward relative to the at least one side wall.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some mechanical details of example floors and shelters, including other plan and section views of the examples shown and of examples that may have alternative configurations, have not been included, such details are considered well within the comprehension of those of skill in the art in light of the present disclosure. It also should be understood that the present invention is not limited to the example embodiment illustrated.

DETAILED DESCRIPTION OF THE PREFERRED EMBODIMENTS

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1-4, it will be appreciated that removable floors for portable shelters, portable shelter constructions and methods of making a floor and shelter of the present disclosure generally may be embodied within numerous configurations, and may be used in various ways to alter and enhance the comfort and convenience of users. Indeed, while acknowledging that all of the example configurations of shelters need not be shown herein, an example is provided and described to better demonstrate that a variety of configurations and methods are contemplated.

Turning to FIGS. 1-4, an example embodiment of a removable floor 10 is shown for use with a portable shelter 50. The floor 10 includes a central section 12 defining a ground engaging area, preferably of a polygonal shape, which in this example is a hexagonal shape. The central section 12 includes at least one layer constructed of a non-permeable material and having an upper surface 12*a*. The non-permeable material of the at least one layer of the central section 12 generally may be a sheet material that could be referred to as a plastic, vinyl or rubber, and preferably is a single-ply flame retardant polyvinyl chloride (FR PVC) sheet material, although it will be appreciated that other non-permeable materials may be used. It further will be appreciated that the central section 12 may be constructed using more than one layer, whether the at least one additional layer is constructed of a non-permeable or other material.

Figure 3:
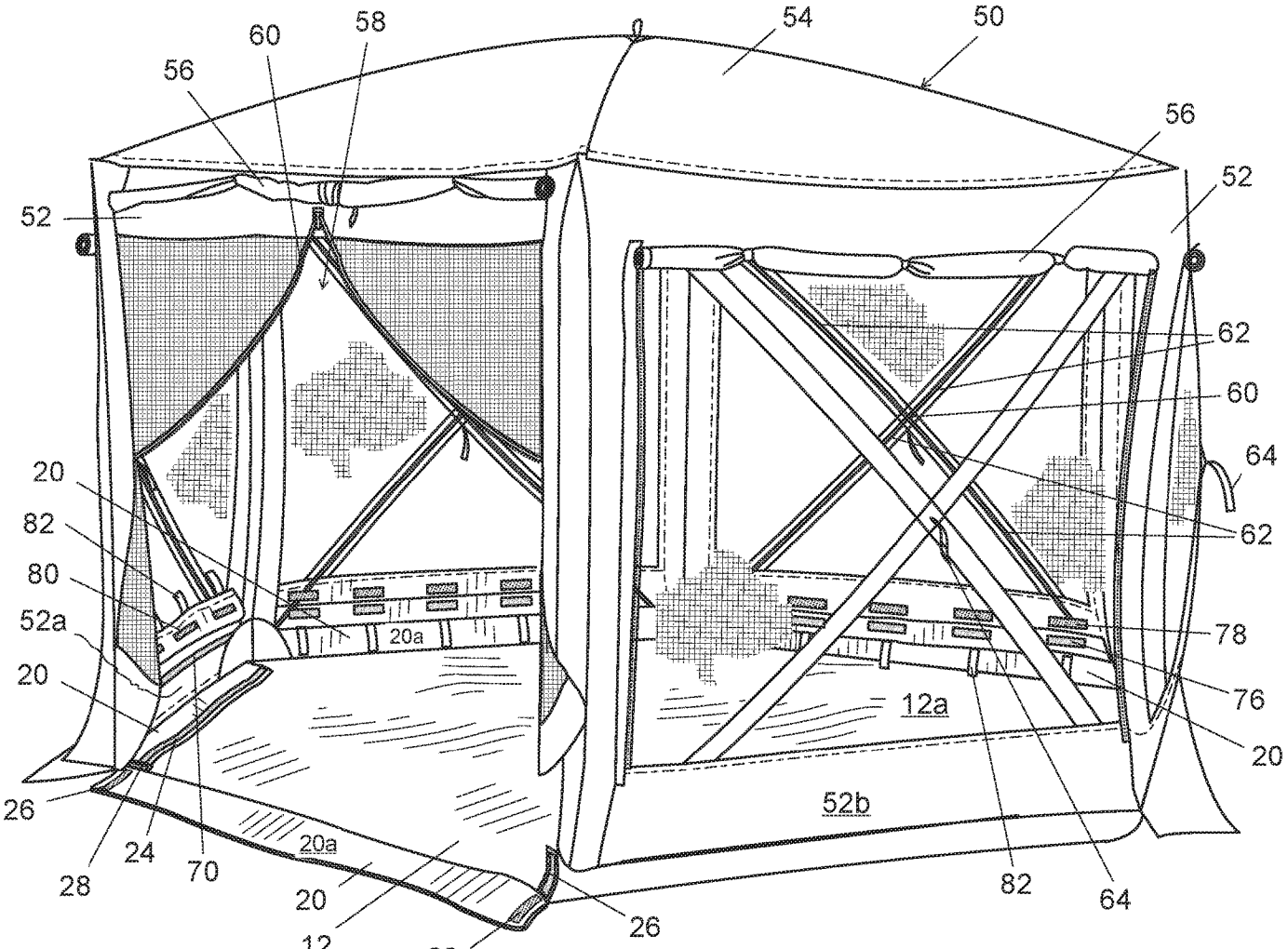
FIG. 3 is a perspective view of the example removable floor and portable shelter of FIG. 1, showing a shelter side wall in an open position, as in FIG. 2, but with the removable floor in position within the shelter and connected to at least one shelter side wall, while showing the structures on another side wall used to connect the floor to a shelter side wall and to cover the connection.
Figure 4:
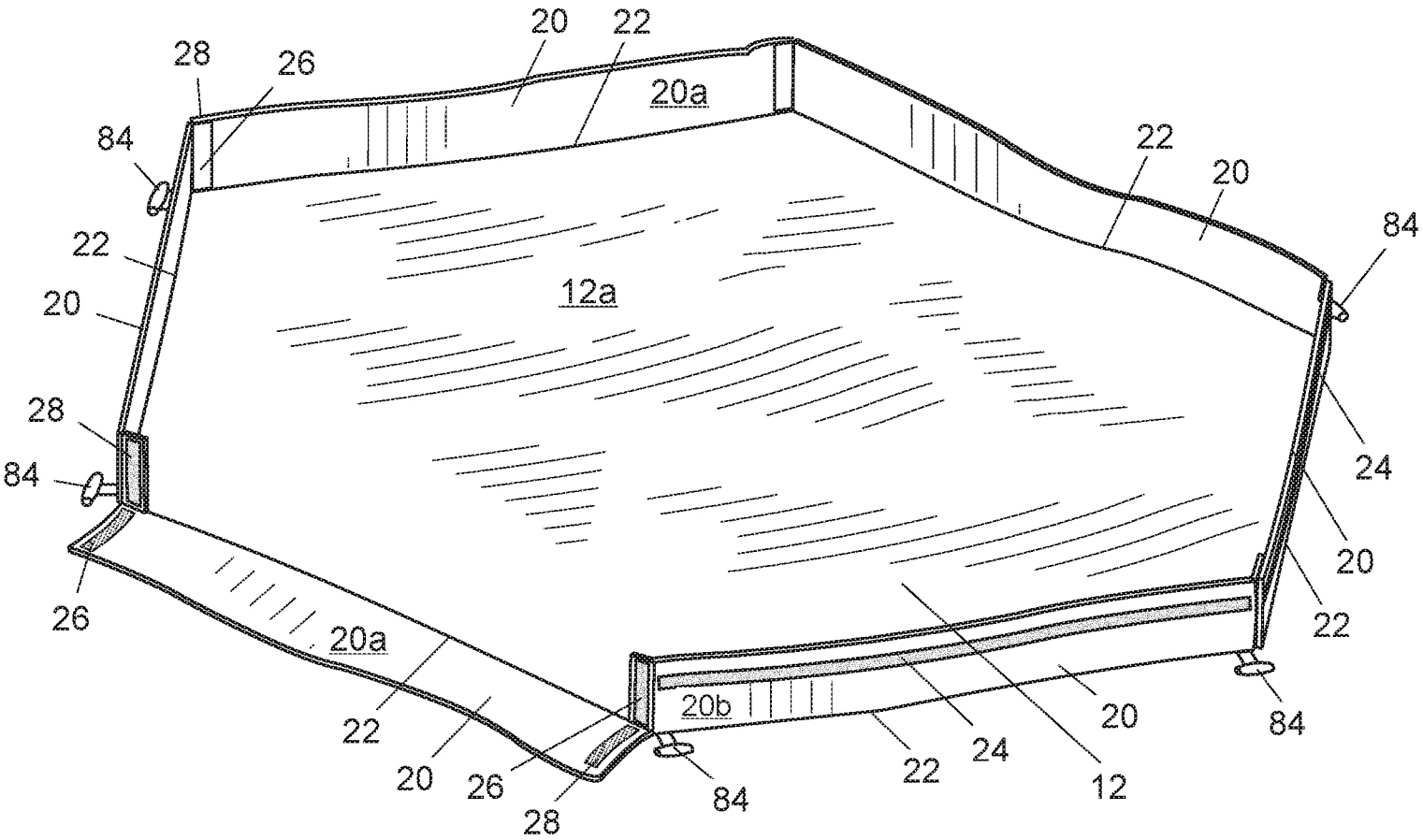
FIG. 4 is a perspective view of the example removable floor of FIGS. 1 and 3, and showing side walls extending upward with outward facing fasteners and one of the side walls disconnected at its ends and folded downward.

The removable floor 10 further includes at least one side wall 20 extending upward from and being connected to the central section 12 at an edge 22 of the ground engaging area and further comprising at least one layer constructed of a non-permeable material, such as is used in the at least one layer of the central section 12. The at least one side wall 20 has an inward facing surface 20*a* and an outward facing surface 20*b*, with an outward facing side wall fastener 24 located on the outward facing surface 20*b*. The outward facing side wall fastener 24 includes a releasable connector of suitable structure and preferably includes one of a hook or loop fastener, or the like. As best seen in FIGS. 3 and 4, it will be understood that the floor 10 may include and preferably includes a plurality of side walls 20 extending upward from and being connected to the central section 12 at edges 22 of the ground engaging area. Each of the plurality of side walls 20 has ends 26, 28 that are connected to ends of respective adjacent side walls. The connection of the ends 26, 28 of the respective adjacent side walls may be permanent, such as by being stitched together, or preferably may be releasable, such as by use of complementary releasable fasteners on the respective ends. The respective ends 26, 28 are shown as including hook and loop fasteners, so as to permit a side wall 20 to be folded downward to lie flat against a ground surface.

The at least one side wall 20 of the floor 10 may be an integral extension from the central section 12. This may be the case whether the central section 12 extends into the upward extending side wall 20 as a single layer or either portion includes more than one layer. Alternatively, the side wall 20 could be separately formed and then joined to the central section 12 proximate its edges 22, such as by use of a heat weld, adhesive or other suitable method of joining the respective components.

Figure 1:
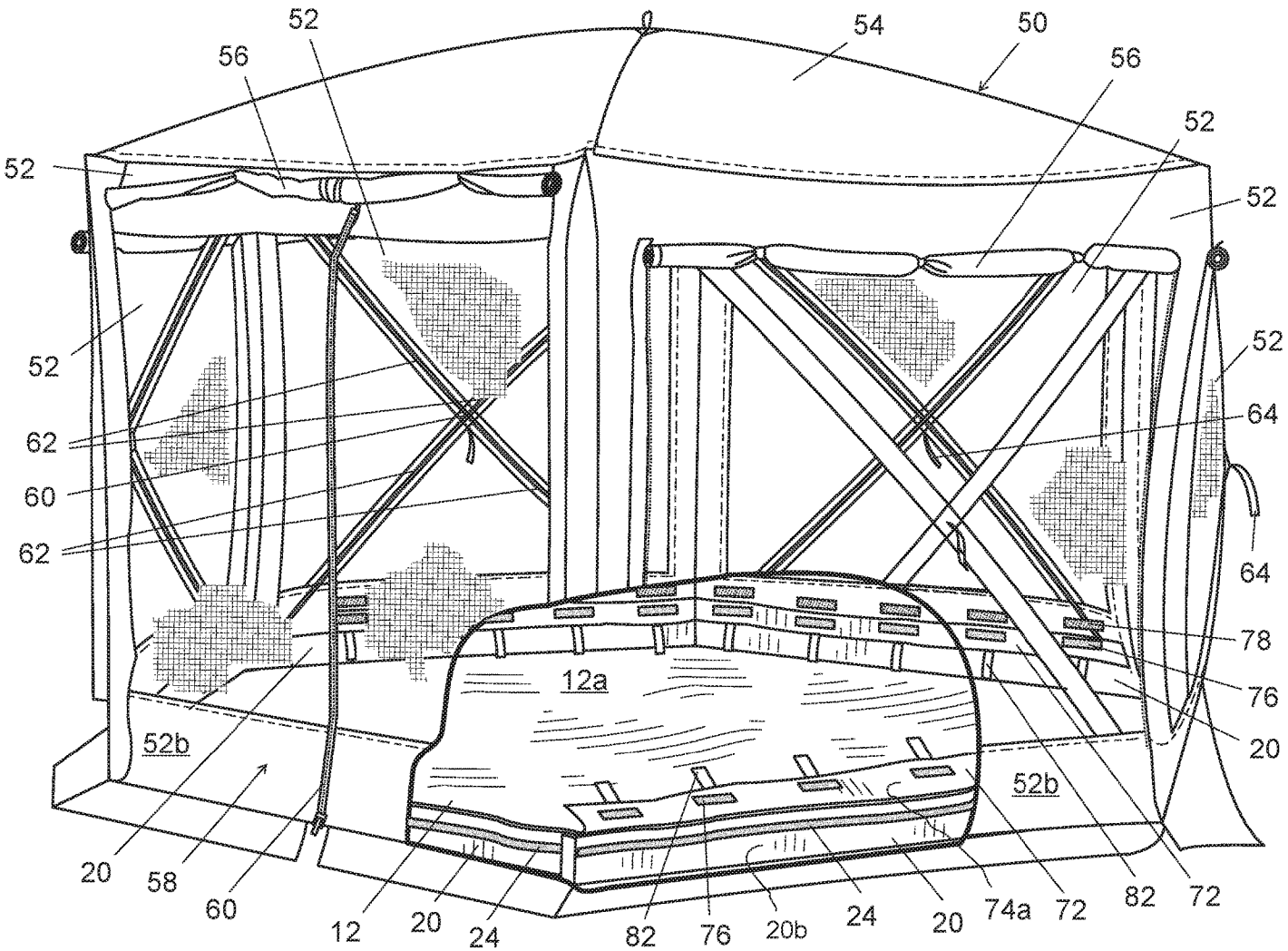
FIG. 1 is a perspective view of an example portable shelter having a removable floor installed, as partially seen through screen portions of the shelter side walls and a cut away.

As noted, the removable insulated floor 10 may be for use with a portable shelter 50. The portable shelter 50 generally includes a portable enclosure that has a plurality of interconnected shelter side walls 52 defining a floor space and being connected to a top wall 54. As seen in FIGS. 1 and 3, any of the side walls 52 or the top wall 54 may be constructed of a fabric including any suitable material, which may include screen material within the shelter side walls 52, as shown. As further seen in FIG. 2, the shelter 50 also may provide at least one flap 56 to cover a flow through area that features screen material.

For convenience of entry and exit to the defined floor space of the shelter 50, at least one of the shelter side walls 52 may include a doorway 58. The doorway 58 is shown as having a zipper 60 that provides an entrance in FIGS. 2 and 3, but is closed in FIG. 1. It will be appreciated that alternative configurations and fastening structures may be used to form a doorway. A side wall 52 or the top wall 54 also may include a window constructed of a transparent material or a non-transparent flap that may extend over an opening in a side wall.

The shelter 50 further may be a collapsible, portable shelter and at least one of the side walls 52 or the top wall 54 may further include a pop up structure having a hub 60 that is connected to a plurality of rods 62, with the rods 62 being connected to the corners of the side walls 52 and/or top wall 54, so as to place the respective fabric panel in tension and support the at least one side wall 52 and/or top wall 54. Pull straps 64 may be provided to facilitate moving the hubs 60 to place the panels in tension.

Figure 2:
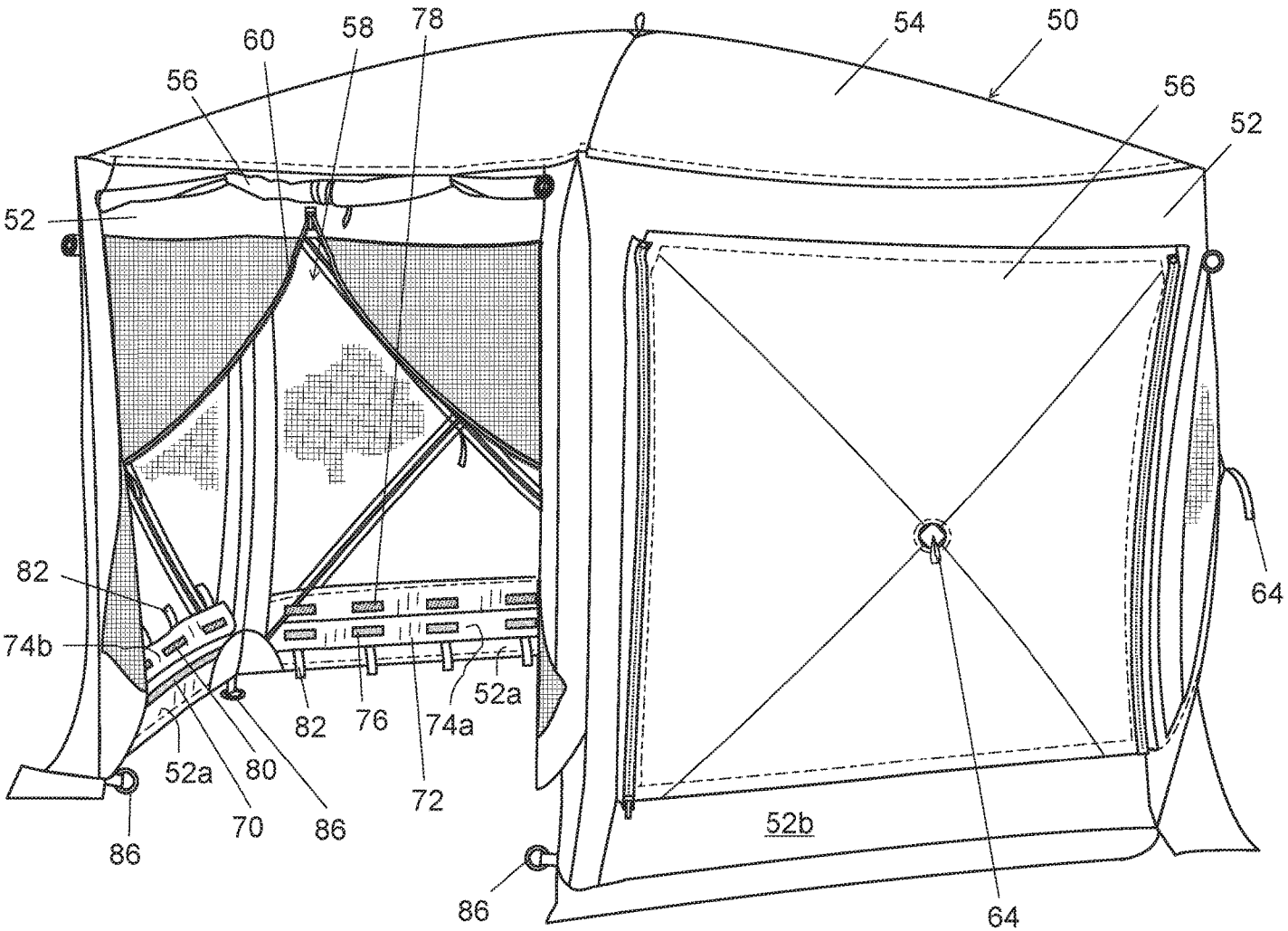
FIG. 2 is a perspective view of the example portable shelter of FIG. 1, showing a shelter side wall in an open position, another side wall in a covered position, the removable floor removed, and showing fasteners that are used in initially locating and then more securely connecting the removable floor to the shelter.

In FIGS. 1-3, as are visible for different respective side walls 52 of the shelter 50, the at least one of the shelter side walls 52 may further include an inward facing surface 52*a* and an outward facing surface 52*b*, and may include a first shelter side wall fastener 70 located on the inward facing surface 52*a* of the side wall 52. The first shelter side wall fastener 70 preferably is elongated to provide a good holding area and secure connection, which may be constructed of a hook or loop fastener material, or other suitable fasteners. The first shelter side wall fastener 70 also is releasably connected to the at least one outward facing side wall fastener 24 located on the outward facing surface 20*b* of the at least one side wall 20 of the removable insulated floor 10. It will be appreciated that the shelter 50 may include a plurality of side walls 52, and each side wall 52 may include an inward facing surface and an outward facing surface, with a first shelter side wall fastener 70 located on the inward facing surface. For a secure connection of the floor 10 to a shelter 50, the floor 10 may correspondingly include a plurality of side walls 20, with each side wall 20 extending upward from and being connected to the central section 12 at an edge 22 of the ground engaging area and having an outward facing side wall fastener 24 located on the outward facing surface 20*b* of the respective side wall 20, and with a respective first shelter side wall fastener 70 on the inward facing surface 52*a* of each shelter side wall 52 releasably connected to the respective outward facing side wall fastener 24 located on the outward facing surface 20*b* of one of the side walls 20 of the floor 10.

To assist in preventing items from becoming inadvertently attached to the first shelter side wall fastener 70 on a side wall 52 of the shelter 50, it is helpful to be able to cover the first shelter side wall fastener 70 when it is not connected to an installed floor 10. As such, at least one of the shelter side walls 52 may further include a flap 72 connected to the at least one shelter side wall 52 at a location above the at least one side wall 20 of the floor 10. The flap 72 may include an upward facing surface 74*a* and a downward facing surface 74*b*, wherein the flap 72 has at least one flap fastener 76 located on the upward facing surface 74*a*, and wherein the at least one flap fastener 76 is connected to a second shelter side wall fastener 78 located on the inward facing surface 52*a* of the at least one shelter side wall 52 at a location above where the flap 72 is connected to the at least one shelter side wall 52 when the flap 72 is folded upward.

The flap 72 further may include at least a second flap fastener 80 located on the downward facing surface 74*b*, wherein the at least one second flap fastener 80 is connected to a respective first shelter side wall fastener 70 on a side wall 52 of the shelter 50 when the floor 10 is not installed in the shelter 50 and the flap 72 is folded downward. When the floor 10 is installed in the space defined by the shelter walls 52, the at least one flap 72 may be folded downward simply to cover over the top of the respective upwardly extending side wall 20 that would have a fastener 24 connected to the first shelter side wall fastener 70. It will be appreciated that a plurality of such flaps 72 and associated flap fasteners 76, 80 may be used for convenience to protect first shelter side wall fasteners 70, or to hold the flap 72 upward against a second shelter side wall fastener 78. Also, each flap 72 may include at least one pull tab 82 to facilitate moving the respective flap to an upward or downward folded position.

It can be difficult to maneuver a large portable floor and align fasteners, so to help facilitate this, the floor 10 may further include at least one initial locating fastener 84 extending outward relative to the at least one side wall 20 of the floor 10. An example initial locating fastener 84 is shown as including what may be referred to as a T-shaped fastener, which includes a rod that is connected to the floor 10 by a fabric tab. The shelter 50 may include a respective at least one initial locating fastener 86 proximate a lower end of at least one shelter side wall 52 and extending inward. The at least one initial locating fastener 86 on the shelter 50 may be referred to as a ring-shaped fastener, which includes a ring that is connected to the shelter 50 by a fabric tab.

It will be appreciated that the initial locating fastener 84 extending outward from the floor 10 is releasably connected to the initial locating fastener 86 extending inward from the shelter 50, such as when the rod of the T-shaped initial locating fastener 84 extending from the floor is passed through the ring of the ring shaped initial fastener 86 extending from the shelter 50. It will be appreciated that in a preferred example, a removable insulated floor 10 may have a plurality of side walls 20 extending upward from and being connected to the central section 12 at edges 22 of the ground engaging area and a plurality of initial locating fasteners 84 spaced around the central section 12 and extending outward relative to the plurality of side walls 20 of the floor 10. A shelter 50 then may include a plurality of initial locating fasteners 86 spaced around the shelter 50 proximate a lower end of the shelter side walls 52 and extending inward. This would permit the initial locating fasteners 84 extending outward relative to the side walls 20 of the floor 10 to be releasably connected to the initial locating fasteners 86 extending inward from the shelter 50. Thus, a user may essentially initially lay out the floor 10 and initially connect the floor 10 to the shelter 50 at a plurality of locations, typically at the corners of the floor 10. Thereafter, it should be more convenient for the user to connect the fasteners 24 on the respective outward facing surfaces 20*b* of the side walls 20 of the floor to the respective first shelter side wall fasteners 70 on the inward facing surface of the side walls 52 of the shelter 50. This use of first and second stage fasteners facilitates more convenient floor installation, while ultimately providing for a secure connection of the floor 10 to the shelter 50. As a result, the removable insulated floor 10 can be relatively compact, lightweight, easy to fold or roll for stowing or carrying, and easy to layout and securely install within a shelter 50 in a manner that will result in the floor 10 having a tendency to stay in place.

From the above disclosure, it will be apparent that removable floors for portable shelters constructed in accordance with this disclosure may include a number of structural aspects that provide numerous advantages. The example aspects of removable floors and portable shelter constructions shown herein may exhibit one or more of the above-referenced potential advantages, depending upon the specific design chosen.

It will be appreciated that a removable floor for portable shelters constructed in accordance with the present disclosure may be provided in various configurations. Any variety of suitable materials of construction, configurations, shapes and sizes for the components and methods of connecting the components of the floors and/or shelters may be utilized to meet the particular needs and requirements of an end user. It is to be understood that the invention is not to be limited to the disclosed example embodiments, but rather, is intended to cover various modifications and equivalent arrangements included within the spirit and scope of the appended claims. Thus, the description and drawings should be considered illustrative and not restrictive of the invention, which is limited only by the appended claims and their legal equivalents.

The invention claimed is:

1. A removable floor in combination with a portable shelter having a plurality of interconnected shelter side walls defining a floor space and being connected to a top wall, comprising:

the floor including a central section defining a ground engaging area and comprising at least one layer constructed of a non-permeable material;

at least one side wall extending upward from and being connected to the central section at an edge of the ground engaging area and further comprising at least one layer constructed of a non-permeable material, wherein the at least one side wall has an inward facing surface and an outward facing surface;

an outward facing side wall fastener located on the outward facing surface of the at least one side wall; and at least one initial locating fastener extending outward relative to the at least one side wall;

wherein the plurality of shelter side walls each comprises an inward facing surface and an outward facing surface, and the outward facing side wall fastener located on the outward facing surface of the at least one side wall of the floor being releasably connected to a first shelter side wall fastener located on the inward facing surface of at least one of the shelter side walls; and wherein at least one of the plurality of shelter side walls further comprises a flap connected to the at least one shelter side wall at a location above the at least one side wall of the floor, with the flap having an upward facing surface and a downward facing surface, wherein the flap has at least one flap fastener located on the upward facing surface, and wherein the at least one flap fastener is connected to a second shelter side wall fastener located on the inward facing surface of the at least one shelter side wall at a location above where the flap is connected to the at least one shelter side wall when the flap is folded upward, and where the flap covers the at least one side wall of the floor when the flap is folded downward.

2. The floor in combination with the shelter in accordance with claim 1, wherein the outward facing side wall fastener further comprises a hook or loop fastener.

3. The floor in combination with the shelter in accordance with claim 1, wherein the at least one side wall is an integral extension from the central section.

4. The floor in combination with the shelter in accordance with claim 1, wherein the ground engaging area defined by the central section further comprises a polygonal shape.

5. The floor in combination with the shelter in accordance with claim 1, wherein the at least one side wall further comprises a plurality of side walls extending upward from and being connected to the central section at edges of the ground engaging area.

6. The floor in combination with the shelter in accordance with claim 5, wherein each of the plurality of side walls has ends that are connected to ends of respective adjacent side walls.

7. The floor in combination with the shelter in accordance with claim 6, wherein the ends of the respective adjacent side walls further comprise releasable fasteners.

8. The floor in combination with the shelter in accordance with claim 7, wherein the releasable fasteners further comprise hook and loop fasteners.

9. The floor in combination with the shelter in accordance with claim 1, wherein at least one of the shelter side waits further comprises a doorway.

10. The floor in combination with the shelter in accordance with claim 1, wherein at least one of the side walls of the shelter further comprises screen material.

11. The floor in combination with the shelter in accordance with claim 10, wherein the at least one of the side walls of the shelter that further comprises the screen material also further comprises a flap that covers the screen material.

12. The floor in combination with the shelter in accordance with claim 1, wherein the at least one shelter side wall comprises each of the shelter side walls including a first shelter side wall fastener located on the inward facing surface, wherein the at least one side wall of the floor further comprises a plurality of side walls with each extending upward from and being connected to the central section at an edge of the ground engaging area and having an outward facing side wall fastener located on the outward faring surface of the respective side wall, and with the first shelter side well fastener on the inward facing surface of each shelter side wall releasably connected to the respective outward facing side wall fastener located on the outward facing surface of one of the side walls of the floor.

13. The floor in combination with the shelter in accordance with claim 1, wherein the shelter further comprises at least one initial locating fastener proximate a lower end of at least one shelter side wall and extending inward, and the initial locating fastener extending outward from the floor is releasably connected to the initial locating fastener extending inward from the shelter.

14. The floor in combination with the shelter in accordance with claim 13, wherein the at least one side wall of the floor further comprises a plurality of side walls extending upward from and being connected to the central section at edges of the ground engaging area and the at least one initial locating fastener of the floor further comprises a plurality of initial locating fasteners spaced around the central section and extending outward relative to the plurality of side walls of the floor, wherein the shelter further comprises the at least on initial locating fastener comprising a plurality of initial locating fasteners spaced around the shelter proximate a lower end of the shelter side walls and extending inward, and the initial locating fasteners extending outward relative to the side walls of the floor are releasably connected to the initial locating fasteners extending inward from the shelter.

15. The floor in combination with the shelter in accordance with claim 1, wherein the shelter is collapsible and at least one of the side walls or the top wall further comprises a pop up structure having a hub that is connected to a plurality of rods, with the rods supporting the at least one side wall or top wall.

16. The floor in combination with the portable shelter in accordance with claim 1, wherein at least one of the shelter side walls is a screen wall that has an opening for ingress and egress, and a door flap to fully cover the screen wall.

* * * * *